US009884672B1

(12) United States Patent
Goodwin

(10) Patent No.: US 9,884,672 B1
(45) Date of Patent: Feb. 6, 2018

(54) ELECTROLYTIC PROTECTION SYSTEM FOR STERN DRIVE MARINE MOTORS HAVING A CAVITATION PLATE

(71) Applicant: Wendell W. Goodwin, Walnut, CA (US)

(72) Inventor: Wendell W. Goodwin, Walnut, CA (US)

( * ) Notice: Subject to any disclaimer, the term of this patent is extended or adjusted under 35 U.S.C. 154(b) by 184 days.

(21) Appl. No.: 14/674,040

(22) Filed: Mar. 31, 2015

(51) Int. Cl.

| | |
|---|---|
| ***C23F 13/02*** | (2006.01) |
| ***B63H 20/34*** | (2006.01) |
| ***B63B 9/00*** | (2006.01) |
| ***C23F 13/18*** | (2006.01) |
| ***C23F 13/08*** | (2006.01) |

(52) U.S. Cl.
CPC ..... *B63H 20/34* (2013.01); *B63B 9/00* (2013.01); *C23F 13/08* (2013.01); *C23F 13/18* (2013.01); *B63B 2009/008* (2013.01); *C23F 2213/31* (2013.01)

(58) Field of Classification Search
CPC ..... C23F 13/02; C23F 13/06; C23F 13/08; C23F 13/10; C23F 13/18; C23F 2213/30; C23F 2213/31
USPC ..... 204/196.3–196.31
See application file for complete search history.

(56) References Cited

U.S. PATENT DOCUMENTS 8,043,135 B1 * 10/2011 Corn ..... B63B 17/00 440/66

FOREIGN PATENT DOCUMENTS

CA 2683036 A1 * 4/2010 ..... B60D 1/015

* cited by examiner

*Primary Examiner* — Luan V Van
*Assistant Examiner* — Alexander W Keeling
(74) *Attorney, Agent, or Firm* — Cislo & Thomas, LLP

(57) ABSTRACT

An electrolytic protection system for stern drive marine motors having a cavitation plae, said system comprising an adaptors fixedly secured to said cavitation plate, and an anode mateable with said adopter.

4 Claims, 4 Drawing Sheets

ELECTROLYTIC PROTECTION SYSTEM FOR STERN DRIVE MARINE MOTORS HAVING A CAVITATION PLATE

RELATED CASES

This invention is described in my copending provisional application Ser. No. 61/964,222 filed Dec. 30, 2013 and now abandoned.

FIELD OF INVENTION

This invention relates to marine products and is particularly directed to an electrolytic protection system for stern drive marine motors having a cavitation plate

BACKGROUND

It is well known to provide sacrificial anodes on marine products. On stern drive motors, it is customary to mount sacrificial anodes on the cavitation plate. However, the location of the cavitation plate provides little room to maneuver while installing or replacing anodes. Moreover, prior art methods of mounting anodes on the cavitation plate require that the attaching bolts be completely removed when replacing the anode. Due to the lack of space and the fact that the process of anode replacement takes place under water, and often in reduced visibility, it is easy for the attaching bolts to become misplaced or lost. Also, the procedure is difficult and time-consuming. Thus, the prior art methods and apparatus for anode replacement are unsatisfactory.

BRIEF SUMMARY AND OBJECTS OF INVENTION

These disadvantages of the prior art are overcome with the present invention and improved methods and apparatus are provided for installing and replacing sacrificial anodes on the cavitation plates of stern drive motors which allow quick and easy installation and replacement of sacrificial anodes without complete replacement of the attaching bolts.

These advantages of the present invention are preferably attained by providing an electrolytic protection system for stern drive marine motors having a cavitation plate, said system comprising an adapter fixedly secured to said cavitation plate, and an anode mateable with said adapter.

Accordingly, it is a object of the present invention to provide improved sacrificial anodes.

Another object of the present invention is to provide improved methods for installing and replacing sacrificial anodes on the cavitation plate of stern drive motors.

An additional object of the present invention is to provide improved methods and apparatus for installing and replacing sacrificial anodes on the cavitation plates of stern drive motors which allow quick and easy installation and replacement of sacrificial anodes.

A further object of the present invention is to provide improved methods and apparatus for installing and replacing sacrificial anodes on the cavitation plates of stern drive motors which allow quick and easy installation and replacement of sacrificial anodes without complete replacement of the attaching bolts.

A specific object of the present invention is to provide an electrolytic protection system for stern drive marine motors having a cavitation plate, said system comprising an adapter fixedly secured to said cavitation plate, and an anode mateable with said adapter.

There and other objects and features of the present invention will be apparent from the following detailed description, taken with reference to the figures of the accompanying drawings.

DETAILED DESCRIPTION OF THE INVENTION

Figure 1:
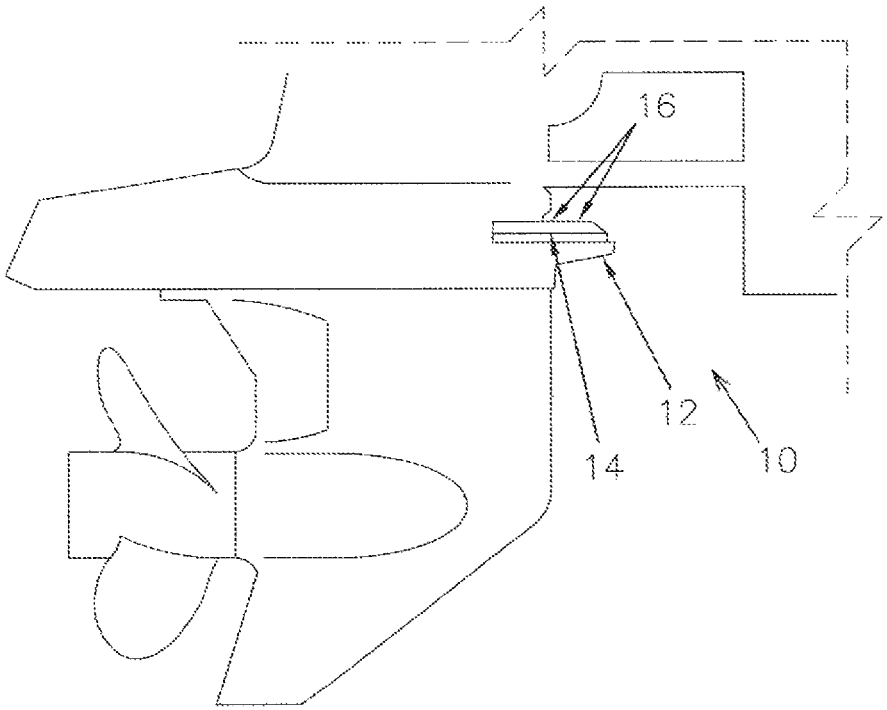
FIG. 1 is a partial side view showing a prior art anode mounted on the cavitation plate of a stern drive motor.
Figure 2:
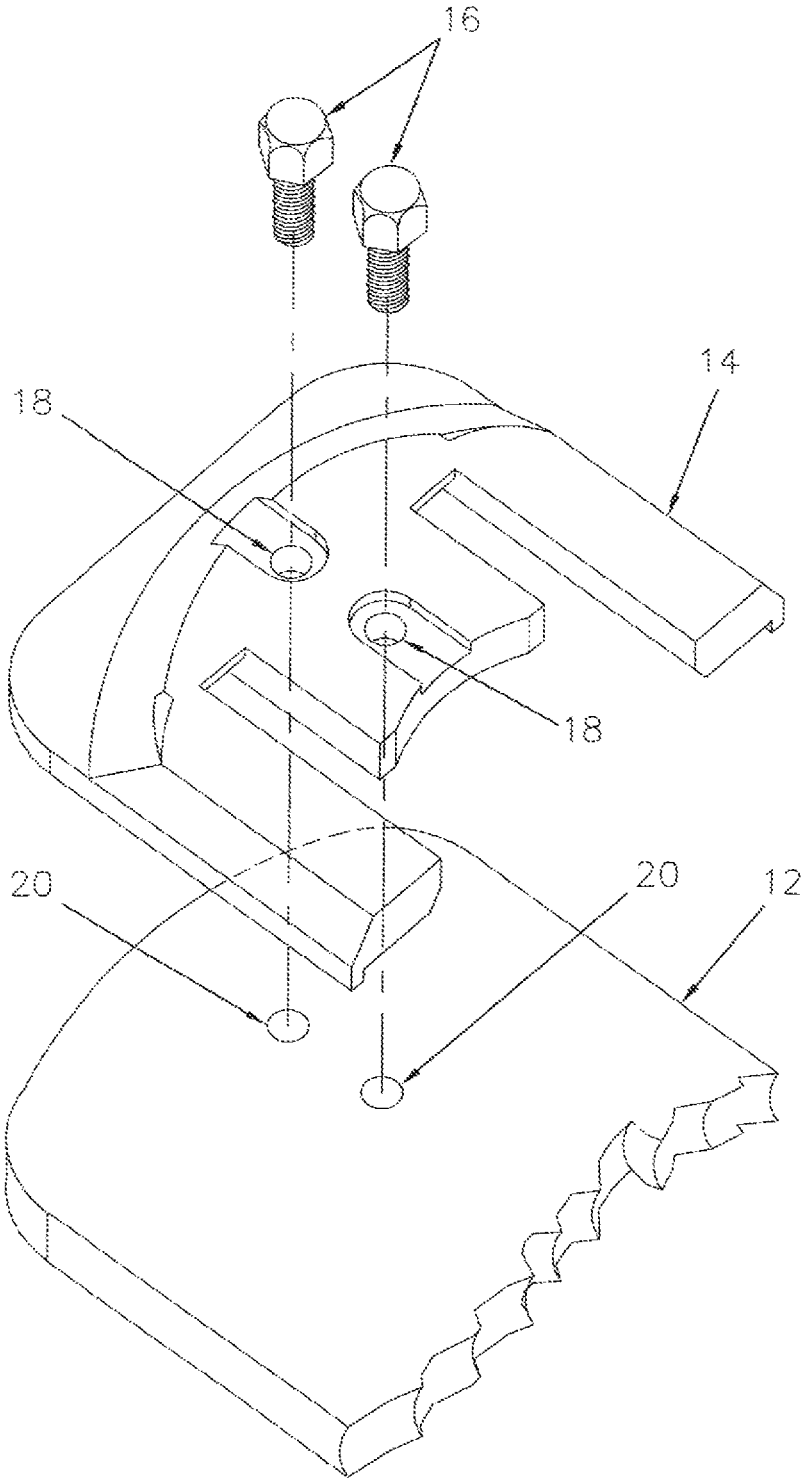
FIG. 2 is an exploded view of the cavitation plate and anode of FIG. 1.

FIG. 1 shows a stern drive motor indicated generally at 10, having a cavitation plate 12 with a sacrificial anode 14 of the prior art secured to the cavitation plate 12 by two bolts 16. As best seen in FIG. 2, the prior art anode 14 is formed with two openings 18 and the bolts 16 pass through openings 18 in the anode and engage threaded openings 20 in the cavitation plate 12.

It will be clear from FIG. 1, that the area around the cavitation plate 12 is quite crowded. Consequently, it is quite difficult to manipulate tools and equipment to install and replace the anode 14. This is especially true since the operation is usually performed under water and often in reduced visibility. To replace the anode 14, it is necessary to completely remove the bolts 16, to remove the old anode 14 and replace it with a new anode 14, then to reinsert and tighten the bolts 16. Working under these difficult conditions, it is easy to drop and lose one or more of the bolts 16.

Figure 3:
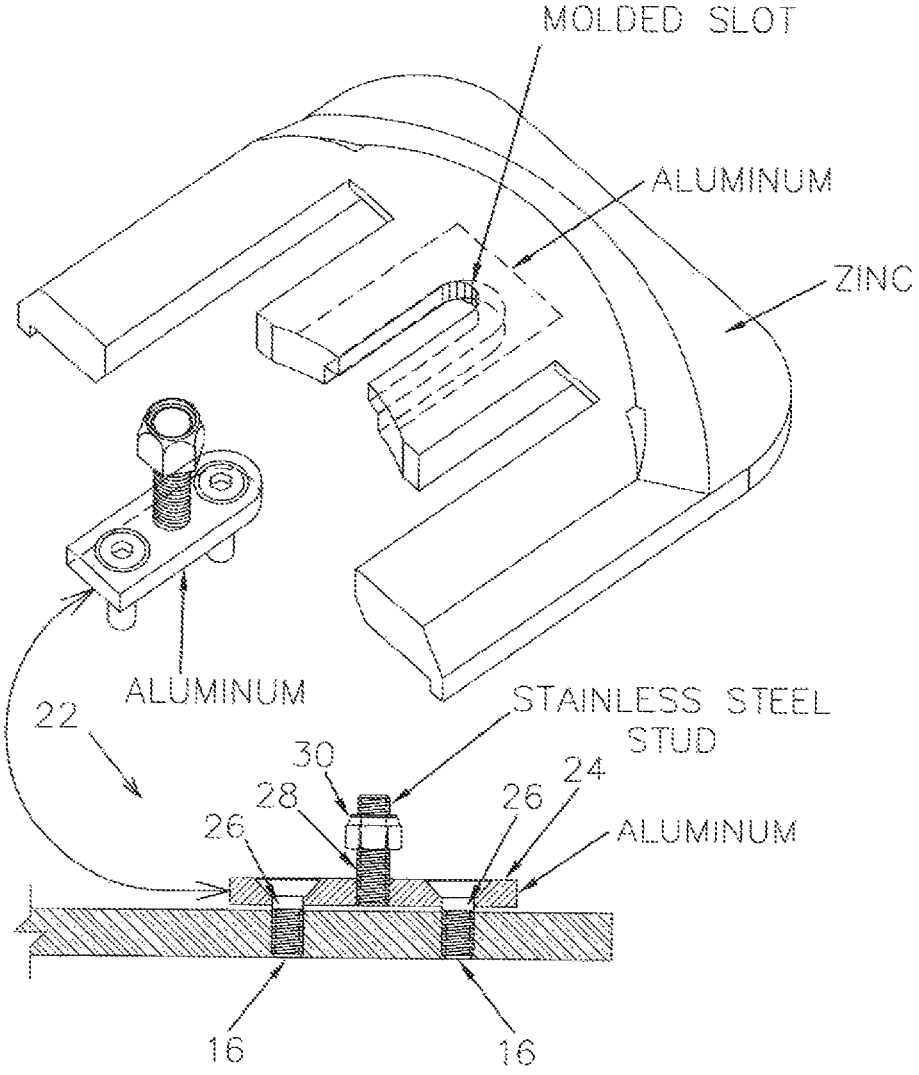
FIG. 3 is a side view of the adaptor of the present invention.

To overcome these problems, the present invention employs an adaptor 22, as seen in FIG. 3, the adaptor 22 comprises a base 24 having a pair of spaced openings 26, to allow passage therethrough of the bolts 16, with a threaded shaft 28 mounted between the openings 26 and a nut 30 threadedly mounted on the shaft 28. The adaptor 22 is fixedly mounted on the cavitation plate 12, with the shaft 28 projecting upwardly, by passing bolts 16 through the openings 26 of the adaptor 22 and securing the bolts 16 in the threaded openings 20 of the cavitation plate 12.

Figure 4:
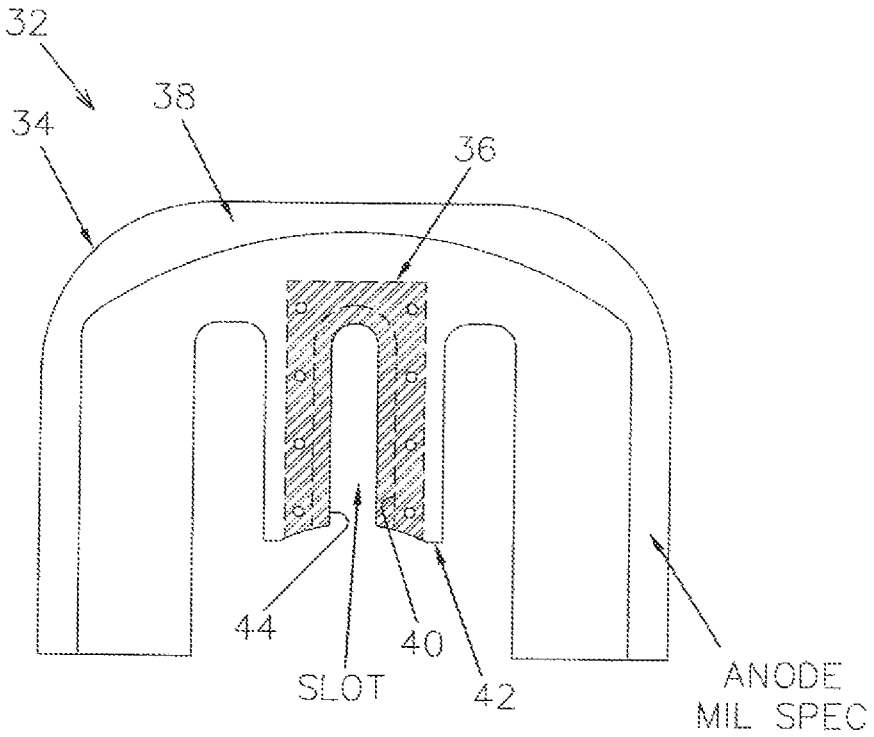
FIG. 4 is a plan view of the anode of the present invention.
Figure 5:
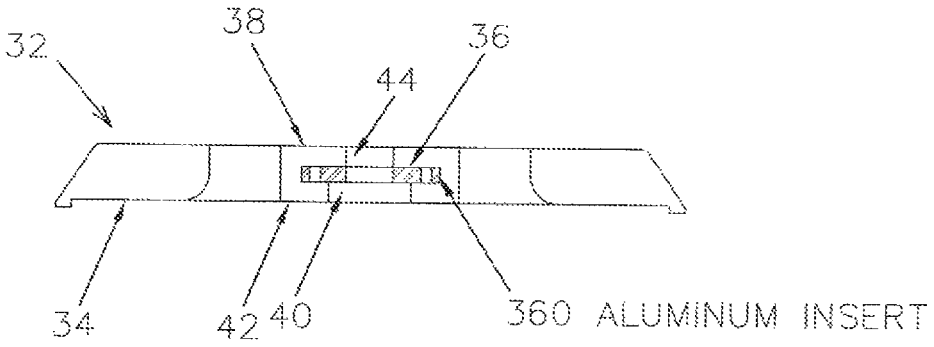
FIG. 5 is a front end view of the anode of FIG. 4.

As seen in FIGS. 4 and 5, the anode 32 of the present invention has a body 34 formed of sacrificial material, such as zinc, with a plate 36 formed of non-sacrificial material embedded in the upper surface 38 of the body 34 of the anode 32. The anode 32 is generally E-shaped having a recess 40 underlining the plate 36 in the center prong 42 of the anode 32. The recess 40 of the node body 34 is formed to slideably receive the base of said adapter. Also, plate 36 is formed with a slot 44 which opens to the rear end of plate 36 and is mateable with the shaft 28 of the adaptor 22. To install or replace the anode 32, the adaptor 22 is mounted on the cavitation plate 12, as described above. Thereafter, the slot 44 of plate 36 is mated with shaft 28 of the adaptor 22 with the plate 36 of anode 32 located below the nut 30. Finally, the nut 30 is tightened on the shaft 28 to clamp the plate 36, and hence the anode 32 to the cavitation plate 12. To replace the anode 32, the nut 30 is loosened sufficiently to allow plate 36 to be moved out of engagement with shaft 28 to allow the old anode 32 to be removed and replaced. Thereafter, nut 30 is tightened to clamp the new anode 32 in place. Since this operation does not require removal of the nut 30, it is not necessary to remove the wrench from the nut. Thus, the operation can be performed quickly and safely with no risk of losing the nut 30. Preferably, the base 24 of the adaptor 32 and plate 36 of anode 32 are formed of aluminum, while threaded shaft 28 and nut 30 are formed of stainless steel.

Obviously numerous variations and modifications can be made without departing from the spirit of the present invention. Therefore, it should be clearly understood that the embodiments of the present invention described above and shown in the accompanying drawing are illustrative only and are not intended to limit the scope of the present invention.

What is claimed is:

1. An electrolytic protection system for stern drive marine engines having a cavitation plate, said system comprising:

an adaptor fixedly secured to said cavitation plate;

an anode mateable with said adaptor;

wherein said adaptor comprises a base, a threaded shaft projecting upwardly from said base, and a nut threadedly mounted on said shaft; and said anode comprises a body having a recess formed to slidably receive the base of said adaptor; and a plate overlying said recess and having a slot opening to the rear of said plate and mateable with the shaft of said adaptor.

2. The system of claim 1 wherein:

said anode is formed from a sacrificial material.

3. The system of claim 1 wherein:

said adaptor is bolted to said cavitation plate.

4. The system of claim 1 wherein:

said plate slot engages said shaft below said nut and said nut can be tightened to securely connect said anode to said adaptor.

* * * * *